US009106008B2

(12) United States Patent
Inagaki et al.

(10) Patent No.: US 9,106,008 B2
(45) Date of Patent: Aug. 11, 2015

(54) ELECTRIC LINE WIRING STRUCTURE OF PLUG

(75) Inventors: Kazuhito Inagaki, Osaka (JP); Shinichi Tsujino, Osaka (JP)

(73) Assignee: Fuji Electric Wire Industries Co., Ltd., Osaka (JP)

( * ) Notice: Subject to any disclaimer, the term of this patent is extended or adjusted under 35 U.S.C. 154(b) by 60 days.

(21) Appl. No.: 13/992,305

(22) PCT Filed: Nov. 9, 2011

(86) PCT No.: PCT/JP2011/075813

§ 371 (c)(1),
(2), (4) Date: Jun. 7, 2013

(87) PCT Pub. No.: WO2013/069107

PCT Pub. Date: May 16, 2013

(65) Prior Publication Data

US 2013/0303031 A1 Nov. 14, 2013

(51) Int. Cl.

| | |
|---|---|
| ***H01R 13/58*** | (2006.01) |
| ***H01R 24/30*** | (2011.01) |
| *H01R 103/00* | (2006.01) |

(52) U.S. Cl.

CPC ..... *H01R 13/5833* (2013.01); *H01R 13/5808* (2013.01); *H01R 13/5845* (2013.01); *H01R 24/30* (2013.01); *H01R 2103/00* (2013.01)

(58) Field of Classification Search

CPC ..... H01R 13/5833
USPC ..... 439/456, 465, 466, 468, 694
See application file for complete search history.

(56) References Cited

U.S. PATENT DOCUMENTS

| | | | | | |
|---|---|---|---|---|---|
| 1,665,510 | A | * | 4/1928 | Spidel | 439/457 |
| 2,027,853 | A | * | 1/1936 | Benander | 439/456 |
| 2,119,810 | A | * | 6/1938 | Grant | 439/447 |
| 2,137,162 | A | * | 11/1938 | Hile | 439/456 |
| 2,260,121 | A | * | 10/1941 | Miller | 439/597 |
| 3,380,015 | A | * | 4/1968 | Gaines et al. | 439/459 |
| 3,611,247 | A | * | 10/1971 | Adams et al. | 439/106 |
| 4,210,380 | A | * | 7/1980 | Brzostek | 439/456 |
| 5,217,389 | A | * | 6/1993 | MacKay et al. | 439/466 |
| 5,482,478 | A | * | 1/1996 | Liao | 439/620.29 |

(Continued)

FOREIGN PATENT DOCUMENTS

| | | | |
|---|---|---|---|
| JP | 59-100317 | U | 7/1984 |
| JP | 7-335301 | A | 12/1995 |
| JP | 2003-178835 | A | 6/2003 |

OTHER PUBLICATIONS

International Search Report issued in PCT/JP2011/075813 mailed on Dec. 6, 2011 (2 pages).

*Primary Examiner* — James Harvey
(74) *Attorney, Agent, or Firm* — Osha Liang LLP

(57) ABSTRACT

An electric line wiring structure of a plug includes a plurality of terminals to be inserted into a power supply and electric lines connected to the terminals. The plurality of terminals protrudes on a front side of a plug main body. The electric lines are connected on a rear side of the plug main body. An electric line wiring section for wiring the electric lines connected to the terminals is provided in the plug main body. An electric line holding section for holding the electric lines in a deformed state is provided on a wiring path for wiring the electric lines, which are set in the electric line wiring section. The electric lines are deformed in a direction perpendicular to the wiring path.

2 Claims, 7 Drawing Sheets

(56) References Cited

U.S. PATENT DOCUMENTS

| | | | | |
|---|---|---|---|---|
| 5,533,911 | A * | 7/1996 | Elam | 439/459 |
| 5,746,618 | A * | 5/1998 | Gauker | 439/352 |
| 6,302,724 | B1 * | 10/2001 | Meller | 439/457 |
| 6,805,578 | B2 * | 10/2004 | Chiou et al. | 439/469 |
| 6,910,904 | B2 * | 6/2005 | Herrick et al. | 439/271 |
| 7,727,003 | B2 * | 6/2010 | Ceroll et al. | 439/447 |
| 7,806,717 | B2 * | 10/2010 | Nakano | 439/367 |
| 2002/0055299 | A1 * | 5/2002 | Zweigle | 439/468 |
| 2011/0216509 | A1 * | 9/2011 | Mikami | 361/730 |
| 2013/0303031 | A1 * | 11/2013 | Inagaki et al. | 439/694 |

* cited by examiner

ELECTRIC LINE WIRING STRUCTURE OF PLUG

TECHNICAL FIELD

The present invention relates to an electric line wiring structure of a plug usable for supplying electric power to, for example, a charging plug for an electric vehicle or a hybrid vehicle, or a microwave oven, an electric toaster, an electronic device, an electric device, an electric tools or the like.

BACKGROUND ART

A conventionally proposed plug of the type described above is, for example, a power supply plug having a structure in which a core wire of an electric line is connected to a base portion of a terminal and a tip end of the electric line and the base portion of the terminal are covered with a vinyl chloride resin so that the electric line and the terminal are integrated together (see Patent Document 1). Such a power supply plug has an electric line wiring structure in which the core wire exposed from the tip end of the electric line is connected to the base portion of the terminal by caulking or soldering.

However, such a power supply plug may be pulled out of a power supply such as, for example, an electric outlet, without being held by hand; namely, the electric line connected to the power supply plug may be pulled by hand. There are also cases where a human, an animal, a cart, a trolley or the like may be caught by the electric line, resulting in the power supply plug being forcibly pulled out.

When the power supply plug is pulled out in a manner described above, a tensile load is applied to the electric line. This tensile load is directly applied to a connection portion of the electric line and the terminal. Therefore, for example, delamination or line breakage easily occurs on the connection portion of the electric line and the terminal. This causes a problem that the electric connection cannot be maintained.

CITATION LIST

Patent Literature

Patent Document 1: Japanese Laid-Open Patent Publication No. Hei 7-335301

SUMMARY OF INVENTION

Technical Problem

The present invention has an object of providing an electric line wiring structure of a plug which provides stable electric connection between an electric line and a terminal for a long time and guarantees a prescribed conductivity.

Solution to Problem

The present invention is directed to an electric line wiring structure of a plug, the plug comprising a plurality of terminals to be inserted into a power supply, the plurality of terminals protruding on a front side of a plug main body; and electric lines connected to the terminals, the electric lines being connected on a rear side of the plug main body. An electric line wiring section for wiring the electric lines connected to the terminals are provided in the plug main body; and an electric line holding section for holding the electric lines in a deformed state is provided on a wiring path for wiring the electric lines, which is set in the electric line wiring section, the electric lines being deformed in a direction perpendicular to the wiring path.

According to the present invention, stable electric connection is provided between the electric lines and the terminals for a long time and a prescribed conductivity is guaranteed.

This will be described in more detail. The electric lines connected to the terminals are wired along the wiring path which is set in the electric line wiring section of the plug main body. The electric lines are, for example, curved, bent or folded in a direction perpendicular to the wiring path and thus are held in such a deformed state by the electric line holding section provided on the wiring path.

It is assumed that in the state where the plug described above is inserted into a power supply such as, for example, an electric outlet or the like, a hand pulls the electric line to draw the plug from the electric outlet; or a human, an animal, a cart, a trolley or the like is caught by the electric line and as a result, the plug is drawn from the electric outlet. In such a case, a tensile load by, for example, curving, bending, folding or the like is applied to the electric lines connected to the plug.

The tensile load applied to the electric lines acts to extend straight the deformed portions of the electric lines held by the electric line holding section of the electric line wiring section. However, the deformed portions of the electric lines are held in the deformed state by the electric line holding section. Therefore, as the tensile load is applied more to the electric lines, the deformed portions of the electric lines are pressed more to the electric line holding section.

Owing to this, the tensile load applied to the electric lines can be received by the electric line holding section on the wiring path to which the deformed portions of the electric lines are pressed.

As a result, the tensile load applied to the electric lines is prevented from being directly applied to connection portions of the electric lines and the terminals, and thus a good connection state can be maintained.

In addition, as the tensile load applied to the electric lines is larger, the deformed portions of the electric lines are pressed to the electric line holding section more strongly. Therefore, a contact resistance generated at the pressing positions can prevent a change of the wiring state or the wiring positions of the electric lines wired to the electric line wiring section. In addition, an effect that the electric line is prevented from being drawn from the plug main body is provided.

In an embodiment of the present invention, a plurality of the electric line holding sections may be located along the wiring path with a gap which allows the electric lines to be wired.

According to the present invention, the tensile load applied to the electric lines can be dispersed, and thus a strength which withstands the tensile load is guaranteed.

This will be described in more detail. The electric lines connected to the terminals are held in a state of being deformed in the direction perpendicular to the wiring path by the plurality of electric line holding sections which are set on the wiring path.

The tensile load applied to the electric lines wired as described above acts to extend straight the deformed portions of the electric lines held by the electric line holding sections. However, the deformed portions of the electric lines are held in the deformed state by the electric line holding sections. Therefore, the tensile load applied to the electric lines can be received by the plurality of electric line holding sections located on the wiring path.

As a result, the tensile load is applied in a dispersed manner to the plurality of electric line holding sections. Therefore, the tensile load received by each of the electric line holding sections is made small. Thus, the tensile load is prevented from being applied to one electric line holding section in a concentrated manner.

In an embodiment of the present invention, the wiring path may be set in a circumferential direction as centered around a central portion of the electric line wiring section; and a plurality of the electric line holding sections may be located along the wiring path set in the circumferential direction, with a gap which allows the electric lines to be wired.

According to the present invention, the tensile load is dispersed in the circumferential direction, and the tensile load received by each of the electric line holding sections is made small.

This will be described in more detail. The electric lines connected to the terminals are wired in a circumferential direction along the wiring path which is set in the electric line wiring section, and are held in a state of being deformed in the direction perpendicular to the wiring path by the plurality of electric line holding sections which are set in the circumferential direction.

The tensile load applied to the electric lines wired as described above acts to extend straight the deformed portions of the electric lines held by the electric line holding sections. However, the deformed portions of the electric lines are held in the deformed state by the electric line holding sections. Therefore, the tensile load applied to the electric lines can be received by the plurality of electric line holding sections located on the wiring path in the circumferential direction and thus can be dispersed in the circumferential direction.

As a result, the tensile load is applied in a dispersed manner to the plurality of electric line holding sections, and is also dispersed in the circumferential direction. Therefore, the tensile load received by each of the electric line holding sections is made small. Thus, the durability against the tensile load is improved.

In an embodiment of the present invention, the wiring path may be set on each of two sides of a center line which is set at a position passing a central portion of the electric line wiring section in a width direction, the wiring path being parallel to a longitudinal direction of the plug main body; and a plurality of the electric line holding sections may be located along the wiring path set on each of the two sides of the center line, with a gap which allows the electric lines to be wired.

According to the present invention, the tensile load can be dispersed in the width direction, and thus the tensile load received by each of the electric line holding sections is made small.

This will be described in more detail. The electric lines connected to the terminals are wired along both of the two wiring paths which are set in the electric line wiring section of the plug main body. The electric lines are held in a state of being deformed in the direction perpendicular to the wiring paths by the electric line holding sections located on the two wiring paths.

The tensile load applied to the electric lines wired as described above acts to extend straight the deformed portions of the electric lines pressed to the electric line holding sections. However, the electric lines are held in the deformed state by the electric line holding sections. Therefore, the tensile load applied to the electric lines can be received by the plurality of electric line holding sections located on the two wiring paths and thus can be dispersed in the width direction.

As a result, the tensile load is applied in a dispersed manner to the plurality of electric line holding sections, and is also dispersed in the width direction. Therefore, the tensile load received by each of the electric line holding sections is made small. Thus, the durability against the tensile load is improved.

In an embodiment of the present invention, the electric line holding sections may be located at a position eccentric externally to the wiring path and a position eccentric internally to the wiring path so as to be alternate with respect to the wiring path.

According to the present invention, the tensile load can be dispersed to outer positions and inner positions, and the tensile load received by each of the electric line holding sections is made smaller.

This will be described in more detail. The electric lines connected to the terminals are deformed in the direction perpendicular to the wiring path which is set in the electric line wiring section. The deformed portions of the electric lines are held by the electric line holding section located outer to the wiring path and the electric line holding section located inner to the wiring path, so that the deformed portions are located alternately with respect to the wiring path.

The tensile load applied to the electric lines wired as described above acts to extend straight the deformed portions of the electric lines held by the electric line holding section located at an outer position and the electric line holding section located at an inner position. However, the electric lines are held in the deformed state by the electric line holding section located at the outer position and the electric line holding section located at the inner position. Therefore, the tensile load applied to the electric lines can be received by the electric line holding section located at the outer position and the electric line holding section located at the inner position. Thus, the tensile load can be dispersed to the outer position and the inner position.

As a result, the tensile load is applied in a dispersed manner to the plurality of electric line holding sections, and is also dispersed to the outer position and the inner position. Therefore, the tensile load received by each of the electric line holding sections is made smaller. Thus, the durability against the tensile load is improved.

The plug main body may be formed of, for example, a thermosetting plastic material such as melamine resin, urea resin, phenol resin or the like; or a thermoplastic material such as PVC resin, polystyrene resin, polyamide resin, polypropylene resin or the like.

The terminals may be formed of, for example, flat blades, pin-shaped blades or the like. The terminals may be formed of a highly conductive metal material such as, for example, brass, copper, a copper alloy or the like.

The electric lines may be formed, for example, as follows. The entire length of a circumferential surface of a conductor formed of a bundle of great number of copper wires, plated copper wires (plated with gold, tin, etc.) or the like, or the entire length of a circumferential surface of one conductor formed to have a prescribed diameter, is covered with an outer cover formed of, for example, a mixture of thermoplastic materials such as PVC resin, polyethylene resin and the like or a rubber material such as chloroprene rubber, EP rubber, chlorosulfonated polyethylene rubber or the like.

The outer cover may be formed as follows. The entire length of a circumferential surface of a conductor around which an insulating member such as fiber, filament or the like is wound is covered with a rubber material as described above.

Advantageous Effects of Invention

According to the present invention, stable electric connection is provided between a terminal and an electric line for a long time and a prescribed conductivity is guaranteed.

DESCRIPTION OF EMBODIMENTS

Hereinafter, an embodiment of the present invention will be described in detail with reference to the drawings.

Figure 1A:
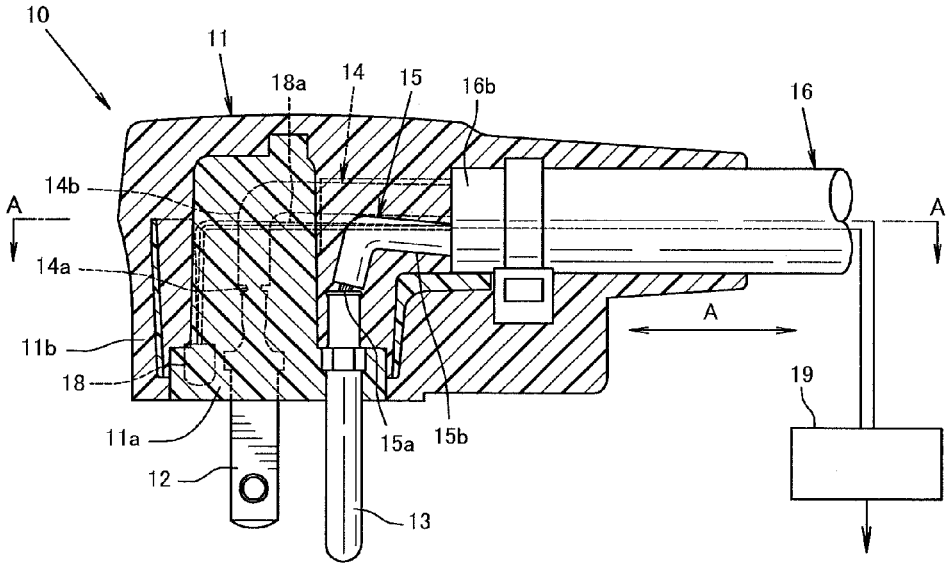
FIGS. 1A and 1B provide a vertical cross-sectional view showing an electric line wiring structure of a plug including a ground terminal, and a cross-sectional view taken along line A-A which shows a wiring state of electric lines.
Figure 1B:
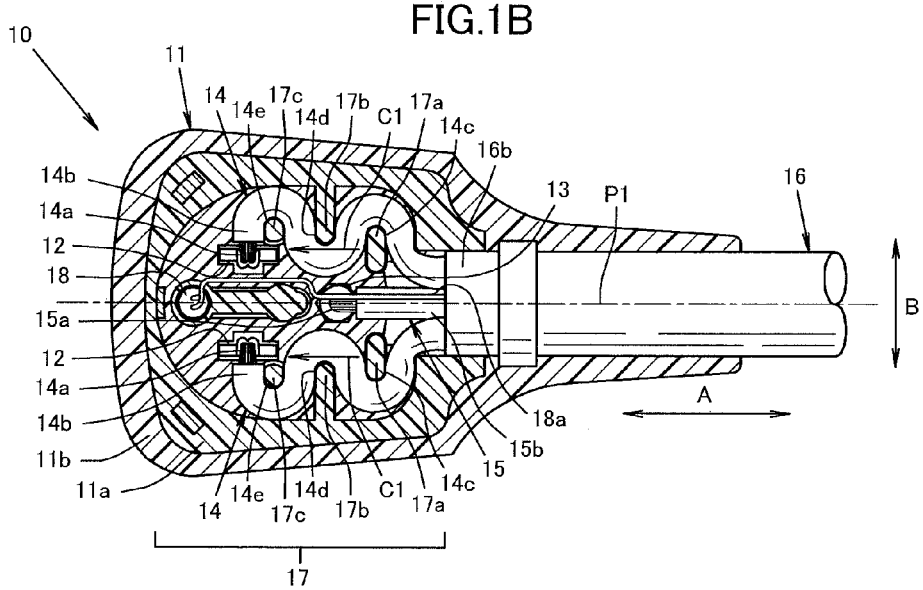

FIG. 1A is a vertical cross-sectional view showing an electric line wiring structure of a plug 10 including a ground terminal. FIG. 1B is a cross-sectional view taken along line A-A, which shows a wiring state of electric lines 14 and 15.

The plug 10 in this embodiment is an L-shaped plug in which terminals 12 and 13 and the electric lines 14 and 15 are respectively connected to each other in a generally right-angled manner. The plug 10 includes a plug main body 11 formed of an insulating plastic material by molding, two flat terminals 12 protruding on a front side of the plug main body 11, a pin-type ground terminal 13 protruding on the front side of the plug main body 11, and a cord 16 for binding together three electric lines 14 and 15 connected to the terminals 12 and 13. The cord 16 is connected on a rear side of the plug main body 11.

The cord 16 is connected to a loading device (not shown) via an electric current block device 19 described later.

The plug main body 11 is structured as follows. A base portion of each of the terminals 12 each formed of a flat blade and a base portion of the terminal 13 formed of a pin-type blade are assembled to a core insert member 11*a* formed of a thermosetting plastic material such as a melamine resin or the like. Then, the entirety of the insert member 11*a* except for an end surface thereof having the terminals 12 and the terminal 13 protruding therefrom, the electric lines 14 and 15 connected to the terminals 12 and 13, and a tip-side outer circumferential surface of the cord 16 are covered with a cover-shaped plug body 11*b* formed of a thermoplastic material such as poly(vinyl chloride) or the like. Thus, these elements are integrated together to be L-shaped as seen in a side view.

The plug body 11*b* is formed of the above-described thermoplastic material by an injection molding device (not shown) and covers an outer surface of the insert member 11*a* except for the end surface thereof and the tip-side outer circumferential surface of the cord 16.

The thermoplastic material fills the inside of the plug main body 11 at the time of injection molding. Therefore, the terminals 12 and 13 are fixed as protruding on the front side of the insert member 11*a*, and the electric lines 14 and 15 are fixed in a prescribed wiring state.

The terminals 12 are each formed of, for example, a flat blade of brass defined by JIS C2680 (having a Cu content of 64.0 to 68.0 wt. % and a Pb content of as low as 0.05 wt. %). The terminals 12 protrude from the end surface of the plug main body 11, and are parallel to each other with such a gap that allows the terminals 12 to be inserted into insert openings of an electric outlet (not shown).

The terminal 13 is formed of a pin-type blade of free-cutting brass defined by JIS C3601 (having a Pb content of 1.8 to 3.7 wt. %). The terminal 13 protrudes from the end surface of the plug main body 11 at such a position that allows the terminal 13 to be inserted into a ground opening of the electric outlet.

The electric lines 14 and 15 respectively include core wires 14*a* and 15*a*, each of which is a bundle of a plurality of line conductors, and insulating members 14*b* and 15*b* for covering outer circumferential surfaces of the core wires 14*a* and 15*a*.

Connection-side tips of the electric lines 14 and 15 which are pressure-connected to the base portions of the terminals 12 and 13 are deprived of the insulating members 14*b* and 15*b* so as to expose the core wires 14*a* and 15*a* by prescribed lengths from tips of the insulating members 14*b* and 15*b*.

Exposure-side ends of the core wires 14*a* and 15*a* exposed from the tips of the insulating members 14*b* and 15*b* are respectively pressure-connected to the base portions of the terminals 12 and 13.

The cord 16 binds together and covers the electric lines 14 connected to the terminals 12 and the electric line 15 connected to the terminal 13 with an insulating outer cover 16*b*.

A connection-side tip of the cord 16 which is connected on the rear side of the plug main body 11 is deprived of the outer cover 16*b* so as to expose the electric lines 14 and 15 by prescribed lengths from the tip of the outer cover 16*b*.

The tip of the outer cover 16*b* from which the electric lines 14 and 15 are exposed is connected to an electric line wiring section 17 (described later) on the rear side of the plug main body 11.

Now, with reference to FIGS. 1A and 1B, an electric line wiring structure of wiring the electric lines 14 of the plug 10 will be described.

In the plug main body 11, the electric line wiring section 17 is provided. The electric wiring section 17 is sized and shaped such that the electric lines 14 and 15, exposed from the tip of the outer cover 16*b* of the cord 16 and connected to the terminals 12 and 13, are allowed to be wired.

The electric lines 14 exposed from the tip of the outer cover 16*b* are wired to the electric line wiring section 17 formed in the plug main body 11, and are also wired along left and right wiring paths C1. The left and right wiring paths C1 are set on both of two sides of a center line P1, which is set at a position passing a central portion of the electric line wiring section 17 in a width direction B, and are parallel to a longitudinal direction A of the plug main body 11 (see FIG. 1B.

On the wiring paths C1, electric line holding sections 17*a*, 17*b* and 17*c* are located. The electric line holding sections 17*a*, 17*b* and 17*c* hold the electric lines 14 in a state of being deformed in the width direction B perpendicular to the wiring paths C1 to be U-shaped, or correct the electric lines 14 into such a state.

The electric line holding sections 17*a* through 17*c* are arranged in the longitudinal direction A along the wiring paths C1, with such a gap that allows the electric lines 14 to be wired along the wiring paths C1, and are positionally shifted in the width direction B so as to be located alternately with respect to the wiring paths C1, more specifically, in a hound's tooth check.

The electric line holding sections 17*a* are each located on a phantom line extended in the longitudinal direction A from a tip-side outer circumferential portion of the outer cover 16*b* of the cord 16, and are each located outer to a tip-side central portion of the outer case 16*b* and eccentric internally with respect to the wiring path C1.

The electric line holding sections 17*b* are each located outer to the phantom line extended in the longitudinal direction A from the tip-side outer circumferential portion of the outer cover 16*b* and are each eccentric externally with respect to the wiring path C1. The electric line holding sections 17*b* each extend perpendicularly to the wiring path C1 and protrude toward an inside wall of the electric line wiring section 17.

The electric line holding sections 17*c* are each located outer to the phantom line extended in the longitudinal direction A from the tip-side outer circumferential portion of the outer cover 16*b* and are eccentric more internally with respect to the wiring path C1 than the electric line holding sections 17*b*. The electric line holding sections 17*c* are located in the vicinity of the base portions of the terminals 12 protruding from the plug main body 11.

The electric line 15 connected to the ground terminal 13 is drawn in the longitudinal direction A from the tip of the outer cover 16*b* of the cord 16, and is wired at a central portion of the electric line wiring section 17 in a state of being more relaxed than the electric lines 14.

At a central portion of a front end of the plug main body 11, a thermistor 18 for detecting the temperature of an exposure-side front end surface of the plug main body 11 is located.

The thermistor 18 is located at the central portion of the front end of the insert member 11*a* included in the plug main body 11. The thermistor 18 is located at approximately the center between the terminals 12.

A part of the insert member 11*a* which is between the exposure-side front end surface of the insert member 11*a* and a detection-side tip of the thermistor 18 is formed to have such a thickness that allows the temperature of the exposure-side front end surface to be directly transmitted to the thermistor 18.

Namely, the temperature of the exposure-side front end surface of the insert member 11*a* is directly transmitted to the thermistor 18. Therefore, supply of an electric current from the electric outlet (not shown) to a loading device can be blocked by the electric current block device 19 (described later) before the temperature of the exposure-side front end surface of the insert member 11*a* becomes sufficiently high to cause tracking.

The thermistor 18 is connected to one end of each of signal lines 18*a* wired in the cord 16. The other end of each of the signal lines 18*a* is connected to the electric current block device 19 for blocking the supply of the electric current from the electric outlet (not shown) to the loading device.

The signal lines 18*a* are inserted into the cord 16 in a state of being bound together, and insertion-side circumferential surfaces thereof are covered with the outer cover 16*b*.

The signal lines 18*a* for the thermistor 18 are formed to have a diameter, or are formed of a material, with which when a load (stress) such as, for example, bending, twisting, pulling or the like is applied to the cord 16, the signal lines 18*a* are broken before the core wires 14*a* of the electric lines 14 are broken.

Alternatively, the signal lines 18*a* may be wired to be tense in the longitudinal direction A, such that the signal lines 18*a* are broken before the core wires 14*a* of electric lines 14 are broken when receiving the above-described load (stress).

The loading device may be, for example, a battery mounted on an electric vehicle, a microwave oven, a toaster, an electric device or the like.

The electric current block device 19 calculates a resistance value of the thermistor 18, which changes in accordance with a change of the temperature of the exposure-side front end surface of the insert member 11*a*, based on a detection signal output from the thermistor 18. The electric current block device 19 compares the resistance value of the thermistor 18 and a preset threshold value, and determines whether or not the temperature of the exposure-side front end surface of the insert member 11*a* is equal to or lower than a prescribed temperature.

This will be described more specifically. When the temperature of the exposure-side front end surface of the insert member 11*a* increases, the resistance value of the thermistor 18 decreases. When the temperature of the exposure-side front end surface of the insert member 11*a* decreases, the resistance value of the thermistor 18 increases. Therefore, by detecting the change of the resistance value of the thermistor 18, which changes in accordance with a change of the temperature of the exposure-side front end surface of the insert member 11*a*, the temperature of the exposure-side front end surface of the insert member 11*a* can be determined accurately.

When the temperature of the exposure-side front end surface of the insert member 11*a* is higher than the prescribed temperature and thus it is determined that the resistance value of the thermistor 18 is lower than the preset threshold value, the supply of the electric current from the electric outlet to the loading device is blocked by the electric current block device 19.

When the temperature of the exposure-side front end surface of the insert member 11*a* is equal to or lower than the prescribed temperature and thus it is determined that the resistance value of the thermistor 18 is equal to or higher than the preset threshold value, the supply of the electric current from the electric outlet to the loading device is continued.

When the signal lines 18*a* for the thermistor 18 are broken and thus a circuit for the thermistor 18 is put into an open state (off state), the electric current block device 19 detects that no signal is output from the thermistor 18 and notifies that the signal lines 18*a* are broken based on such detection by use of notification means (not shown).

This will be described more specifically. When a load (stress) such as, for example, bending, twisting, pulling or the like is applied to the cord 16 in the state where the plug 10 is inserted into the electric output, the signal lines 18*a* for the thermistor 18 are broken before the core wires 14*a* of the electric lines 14 are broken.

When the circuit for the thermistor 18 is put into an open state and it is detected that no signal is output from the thermistor 18, it is notified that the signal lines 18*a* are broken based on such detection by use of the notification means (not shown). In this manner, it can be notified that there is an undesirable possibility that the electric lines 14 may be broken.

Now, a method for wiring the above-described electric lines 14 to the electric line wiring section 17 of the plug main body 11 will be described.

First, as shown in FIGS. 1A and 1B, the electric lines 14 exposed from the tip of the outer cover 16*b* of the cord 16 are wired in a bilaterally symmetrical manner along the wiring paths C1, which are set in the electric line wiring section 17 of the plug main body 11.

This will be described more specifically. The electric lines 14 are each deformed in the width direction B perpendicular to the wiring paths C1 to be U-shaped, and deformed portions 14*c*, 14*d* and 14*e* obtained in this manner are hooked along the electric line holding sections 17*a*, 17*b* and 17*c* located on the wiring paths C1. Thus, the electric lines 14 are wired in an S-shaped winding state as shown in FIG. 1B.

This will be described in more detail. The deformed portion 14*c* of each electric line 14, which is deformed in a direction away from the center line P1, is hooked along an outer side of the electric line holding section 17*a* located at an upstream position of the wiring path C1 and is wired in a state of being pressed to the electric line holding section 17*a* from the outer side.

A circumferential surface of each electric line 14 corresponding to the deformed portions 14*c* and 14*e* is pressed to an inside wall of the electric line wiring section 17 and is held in a U-shape-deformed state or corrected into such a state.

The deformed portion 14*d* of each electric line 14, which is deformed in a direction toward the center line P1, is hooked along an inner side of the electric line holding section 17*b* located approximately at the center position of the wiring path C1 and is wired in a state of being pressed to the electric line holding section 17*b* from the inner side.

The deformed portion 14*e* of each electric line 14, which is deformed in a direction away from the center line P1, is hooked along an outer side of the electric line holding section 17*c* located at a downstream position of the wiring path C1 and is wired in a state of being pressed to the electric line holding section 17*c* from the outer side.

It is assumed that, for example, in the state where the plug 10 having the electric lines 14 wired as described above is inserted into the electric outlet (not shown), a hand pulls the cord 16 to draw the plug 10 from the electric outlet; or a human, an animal, a cart, a trolley or the like is caught by the cord 16 and as a result, the plug 10 is drawn from the electric outlet. In such a case, a tensile load by, for example, curving, bending, folding or the like is applied to the electric lines 14 in the cord 16 connected to the plug 10.

Namely, when the above-described tensile load is applied to the cord 16 of the plug 10, the tensile load is applied to only the electric lines 14 because the electric line 15 is relaxed. The tensile load acts to extend straight the deformed portions 14*c* through 14*e* of the electric lines 14 hooked along the electric line holding sections 17*a* through 17*c* of the electric line wiring section 17.

However, the deformed portions 14*c* through 14*e* of the electric lines 14 are held in, or corrected into, a deformed state by the electric line holding sections 17*a* through 17*c*. Therefore, as the tensile load is applied more to the electric lines 14, the deformed portions 14*c* through 14*e* of the electric lines 14 are pressed more to the electric line holding sections 17*a* through 17*c* (see FIG. 1B).

Owing to this, the tensile load applied to the electric lines 14 can be received by the electric line holding sections 17*a* through 17*c* to which the deformed portions 14*c* through 14*e* of the electric lines 14 are pressed, and also the tensile load can be dispersed in the width direction B.

As a result, the tensile load applied to the electric lines 14 is prevented from being directly applied to connection portions of the terminals 12 and the electric lines 14, and thus a good connection state can be maintained. In addition, an electric connection state between the terminals 12 and the electric lines 14 is kept stably for a long time and thus a prescribed conductivity can be guaranteed.

The tensile load applied to the electric lines 14 is applied in a dispersed manner to the electric line holding sections 17*a* located at inner positions and the electric line holding sections 17*b* and 17*c* located at outer positions, and is also dispersed in the width direction B. Therefore, the tensile load received by each of the electric line holding sections 17*a* through 17*c* is made small. Thus, a structural strength which can withstand even a large tensile load is guaranteed, and the durability is improved.

As the tensile load applied to the electric lines 14 is larger, the deformed portions 14*c* through 14*e* of the electric lines 14 are pressed to the electric line holding sections 17*a* through 17*c* more strongly. Therefore, a contact resistance generated at the pressing positions can prevent a change of the wiring state or the wiring positions of the electric lines 14 wired to the electric line wiring section 17. In addition, an anti-drawing effect that the cord 16 is prevented from being drawn from the plug main body 11, and a breakage prevention effect that the cord 16 is prevented from being broken, are provided.

In the state where the plug 10 is inserted into the electric outlet, the temperature of the exposure-side front end surface of the plug 10 is detected by the thermistor 18. Based on the detection signal output from the thermistor 18, the electric current block device 19 determines whether or not the temperature of the exposure-side front end surface of the plug 10 is equal to or lower than the prescribed temperature.

Specifically, when the temperature of the exposure-side front end surface of the plug 10 is higher than the prescribed temperature, the resistance value of the thermistor 18 is lower than the preset threshold value and thus is determined as being lower than the preset threshold value. In this case, the supply of the electric current from the electric outlet to the loading device is blocked.

In this manner, a temperature change at the front end surface of the plug 10 can be accurately detected by the thermistor 18, and thus the supply of the electric current is blocked by the electric current block device 19 before the temperature becomes sufficiently high to cause tracking. Therefore, the front end surface of the plug 10 is not overheated to a temperature higher than the prescribed temperature. Thus, combustion, fire or the like caused by overheating of the plug 10 can be prevented.

When a load (stress) such as, for example, bending, twisting, pulling or the like is applied to the cord 16, the signal lines 18 for the thermistor 18 are broken before the core wires 14*a* of the electric lines 14 are broken, and thus the circuit for the thermistor 18 is put into an open state (off state).

When detecting that no signal is output from the thermistor 18, the electric current block device 19 can notify, before the electric lines 14 are broken, that there is an undesirable possibility that the electric lines 14 may be broken based on such detection by use of the notification means (not shown).

More specifically, the signal lines 18*a* are caused to be broken before the electric lines 14 are broken, and the breakage of the signal lines 18*a* is detected. Owing to this, in the case where a device for which it is not desirable that the electric lines 14 are suddenly broken is used, the entirety of the plug 10 and the cord 16 can be exchanged before trouble occurs due to the sudden breakage of the electric lines 14. As a result, the device can be protected against faults.

Now, an electric line wiring structure of an L-shaped plug 20 according to another example will be described.

Figure 2A:
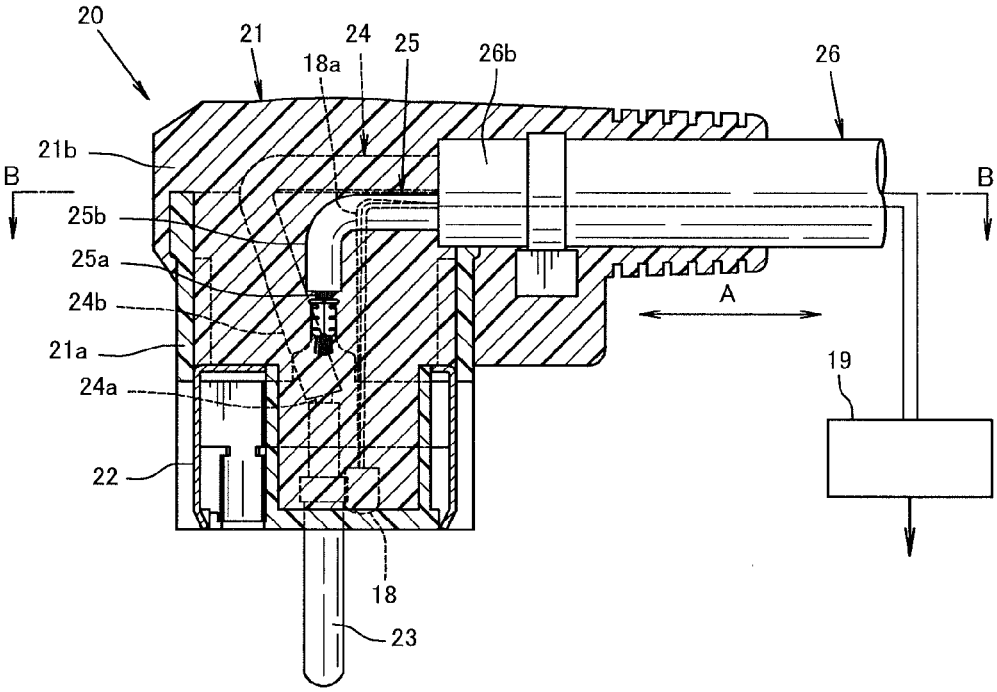
FIGS. 2A and 2B provide a vertical cross-sectional view showing an electric line wiring structure of a plug including a ground terminal, and a cross-sectional view taken along line B-B which shows a wiring state of electric lines.
Figure 2B:
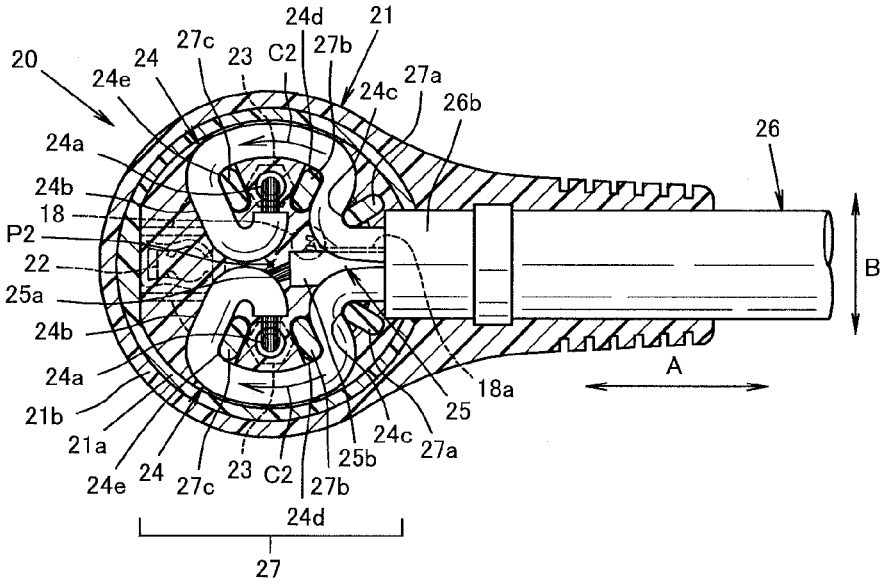

FIG. 2A is a vertical cross-sectional view showing an electric line wiring structure of the plug 20 including a ground terminal. FIG. 2B is a cross-sectional view taken along line B-B, which shows a wiring state of electric lines 24 and 25.

The plug 20 is an L-shaped plug in which terminals 22 and 23 and the electric lines 24 and 25 are respectively connected to each other in a generally right-angled manner. The plug 20 includes a plug main body 21 formed of an insulating plastic material by molding, two pin-shaped terminals 23 protruding on a front side of the plug main body 21, a flat ground terminal 22 buried at a front end of the plug main body 21, and a cord 26 for binding together electric lines 24 connected to the terminals 23 and an electric line 25 connected to the terminal 22. The cord 26 is connected on a rear side of the plug main body 21.

The plug main body 21 is structured as follows. Abase portion of the terminal 22 and a base portion of each of the terminals 23 are assembled to a core insert member 21*a* formed of a thermosetting plastic material. Then, the elements shown in the figures are covered with a cover-shaped plug body 21*b* formed of a thermoplastic material. Thus, these elements are integrated together to be L-shaped as seen in a side view.

The plug body 21*b* is formed of the above-described thermoplastic material by an injection molding device (not shown) and covers an outer surface of the insert member 21*a* except for a front end surface and a front-side outer circumferential surface thereof and a tip-side outer circumferential surface of the cord 26.

The thermoplastic material fills the inside of the plug main body 21 at the time of injection molding. Therefore, the terminals 23 are fixed as protruding on the front side of the insert member 21*a*, the terminal 22 is buried on the front end of the insert member 21*a*, and the electric lines 24 and 25 are fixed in a prescribed wiring state.

The terminals 23 protrude parallel to each other with such a gap that allows the terminals 23 to be inserted into insert openings of an electric outlet (not shown). The terminal 22 is buried at such a position that allows a ground terminal of the electric outlet to be inserted into the terminal 22.

The electric lines 24 and 25 are respectively deprived of tips of insulating members 24*b* and 25*b* provided to cover outer circumferential surfaces of core wires 24*a* and 25*a*, so as to expose the core wires 24*a* and 25*a*. The core wires 24*a* and 25*a* exposed from the tips of the insulating members 24*b* and 25*b* are respectively pressure-connected to the base portions of the terminals 22 and 23.

The cord 26 binds together and covers the electric lines 24 and 25 with an insulating outer cover 26*b*. The cord 26 is deprived of a tip of the outer cover 26*b* so as to expose the electric lines 24 and 25 by prescribed lengths from the tip of the outer cover 26*b*. The tip of the outer cover 26*b* is connected to an electric line wiring section 27 (described later) on the rear side of the plug main body 21.

The electric lines 24 exposed from the tip of the outer cover 26*b* are wired to the electric line wiring section 27 formed in the plug main body 21, and are also wired along left and right wiring paths C2. The left and right wiring paths C2 are set in a circumferential direction as centered around a central portion P2, which is set at a central portion of the electric line wiring section 27 in the width direction B.

The electric line 25 is wired at a central portion of the electric line wiring section 27 in a state of being more relaxed than the electric lines 24.

On the wiring paths C2, electric line holding sections 27*a*, 27*b* and 27*c* are located. The electric line holding sections 27*a*, 27*b* and 27*c* hold the electric lines 24 in a state of being deformed in the width direction B perpendicular to the wiring paths C2 to be U-shaped around the central portion P2, or correct the electric lines 24 into such a state. The electric line holding sections 27*a* are located at an equal distance from the central portion P2, namely, on the circumference of a circle centered around the central portion P2, the electric line holding sections 27*b* are located at an equal distance from the central portion P2, namely, on the circumference of a circle centered around the central portion P2, and the electric line holding sections 27*c* are located at an equal distance from the central portion P2, namely, on a circle centered around the central portion P2.

The electric line holding sections 27*a* through 27*c* are arranged in the circumferential direction along the wiring paths C2, with such a gap that allows the electric lines 24 to be wired. Also, the electric line holding sections 27*a* through 27*c* are located in a hound's tooth check, such that the wiring paths C2 are alternate, more specifically, outer to the electric line holding sections 27*a* and 27*b* and inner to the electric line holding section 27*c*, with respect to the central portion P2.

The electric line holding sections 27*a* are each located in the vicinity of a tip-side outer circumferential portion of the outer cover 26*b* of the cord 26, and are each eccentric externally with respect to the wiring path C2. The electric line holding sections 27*b* and 27*c* are each located outer to a phantom line extended in the longitudinal direction A from the tip-side outer circumferential portion of the outer cover 26*b* and are each eccentric internally with respect to the wiring path C2.

Between the electric line holding sections 27*b* and 27*c*, the terminals 23 connected to the electric lines 24 are located.

The electric lines 24 are wired to the electric line wiring section 27 of the plug main body 21 as follows. As shown in FIGS. 2A and 2B, the electric lines 24 exposed from the tip of the outer cover 26*b* of the cord 26 are wired in a symmetrical manner along the left and right wiring paths C2, which are set in the electric line wiring section 27.

This will be described more specifically. The electric lines 24 are each deformed in the width direction B perpendicular to the wiring paths C2 to be U-shaped, and deformed portions 24*c*, 24*d* and 24*e* obtained in this manner are hooked along the electric line holding sections 27*a*, 27*b* and 27*c* located on the wiring paths C2, such that the deformed portions 24*c*, 24*d* and 24*e* are wound around the electric line holding sections 27*a*, 27*b* and 27*c*. Thus, the electric lines 24 are wired in an S-shaped winding state as shown in FIG. 2B.

This will be described in more detail. As in the above-described embodiment, the tensile load applied to the cord 26 of the plug 20 acts to extend straight the deformed portions 24*c* through 24*e* of the electric lines 24 hooked along the electric line holding sections 27*a* through 27*c* of the electric line wiring section 27.

However, the deformed portions 24*c* through 24*e* of the electric lines 24 are held in, or corrected into, a deformed state by the electric line holding sections 27*a* through 27*c*. Therefore, as the tensile load is applied more to the electric lines 24, the deformed portions 24*c* through 24*e* of the electric lines 24 are pressed more to the electric line holding sections 27*a* through 27*c* (see FIG. 2B).

Owing to this, the tensile load applied to the electric lines 24 can be received by the electric line holding sections 27*a* through 27*c* to which the deformed portions 24*c* through 24*e* of the electric lines 24 are pressed, and also a part of the tensile load can be dispersed in the circumferential direction.

As a result, the tensile load is applied in a dispersed manner to the electric line holding sections 27*a* through 27*c* and also dispersed in the circumferential direction. Therefore, the tensile load received by each of the electric line holding sections 27*a* through 27*c* is made small. Thus, the structural strength and the durability against the tensile load are improved.

In addition, the tensile load is prevented from being directly applied to connection portions of the terminals 23 and the electric lines 24, and thus functions and effects equivalent to those of the above-described embodiment can be provided.

Moreover, an anti-drawing effect that the cord 26 is prevented from being drawn from the plug main body 21, and a breakage prevention effect that the cord 26 is prevented from being broken, are provided.

Now, an electric line wiring structure of an L-shaped plug 30 according to still another example will be described.

Figure 3A:
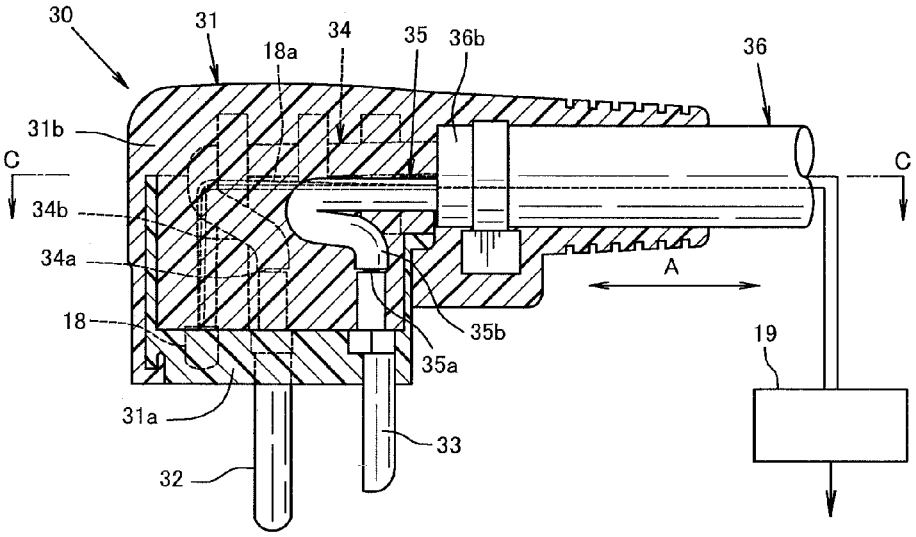
FIGS. 3A and 3B provide a vertical cross-sectional view showing an electric line wiring structure of a plug including a ground terminal, and a cross-sectional view taken along line C-C which shows a wiring state of electric lines.
Figure 3B:
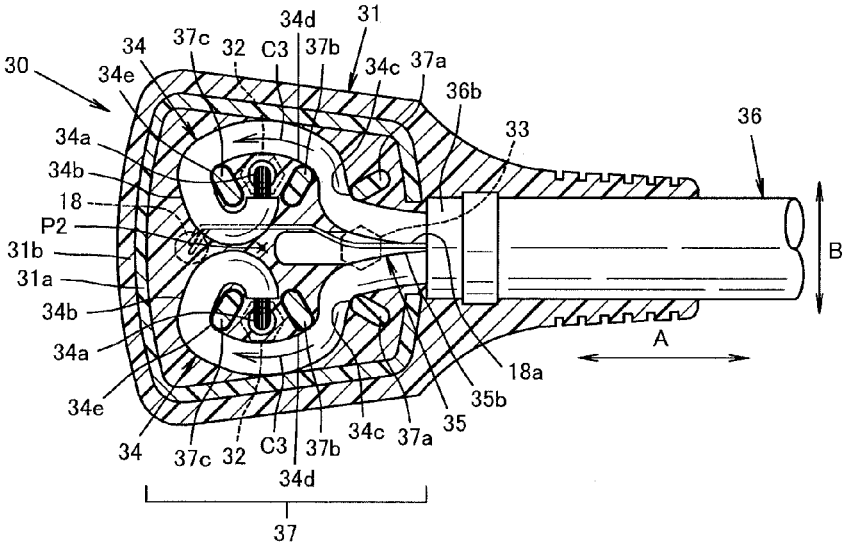

FIG. 3A is a vertical cross-sectional view showing an electric line wiring structure of the plug 30 including a ground terminal. FIG. 3B is a cross-sectional view taken along line C-C, which shows a wiring state of electric lines 34 and 35.

The plug 30 is an L-shaped plug in which terminals 32 and 33 and the electric lines 34 and 35 are respectively connected to each other in a generally right-angled manner. The plug 30 includes a plug main body 31 formed of an insulating plastic material by molding, two pin-shaped terminals 32 protruding on a front side of the plug main body 31, a pin-shaped ground terminal 33 protruding on the front side of the plug main body 31, and a cord 36 for binding together electric lines 34 connected to the terminals 32 and an electric line 35 connected to the terminal 33. The cord 36 is connected on a rear side of the plug main body 31.

The plug main body 31 is structured as follows. A base portion of each of the terminals 32 and a base portion of the terminal 33 are assembled to a core insert member 31*a* formed of a thermosetting plastic material. Then, the elements shown in the figures are covered with a cover-shaped plug body 31*b* formed of a thermoplastic material. Thus, these elements are integrated together to be L-shaped as seen in a side view.

The plug body 31*b* is formed of the above-described thermoplastic material by an injection molding device (not shown) and covers an outer surface of the insert member 31*a* except for an end surface thereof and a tip-side outer circumferential surface of the cord 36.

The thermoplastic material fills the inside of the plug main body 31 at the time of injection molding. Therefore, the terminals 32 and 33 are fixed as protruding from the end surface of the insert member 31*a*, and the electric lines 34 and 35 are fixed in a prescribed wiring state.

The terminals 32 protrude parallel to each other with such a gap that allows the terminals 32 to be inserted into insert openings of an electric outlet (not shown). The terminal 33 protrudes at such a position that allows the terminal 33 to be inserted into a ground opening of the electric outlet.

The electric lines 34 and 35 are respectively deprived of tips of insulating members 34*b* and 35*b* provided to cover outer circumferential surfaces of core wires 34*a* and 35*a*, so as to expose the core wires 34*a* and 35*a*. The core wires 34*a* and 35*a* exposed from the tips of the insulating members 34*b* and 35*b* are respectively pressure-connected to the base portions of the terminals 32 and 33.

The cord 36 binds together and covers the electric lines 34 and 35 with an insulating outer cover 36*b*. The cord 36 is deprived of a tip of the outer cover 36*b* so as to expose the electric lines 34 and 35 by prescribed lengths from the tip of the outer cover 36*b*. The tip of the outer cover 36*b* is connected to an electric line wiring section 37 (described later) on the rear side of the plug main body 31.

The electric lines 34 exposed from the tip of the outer cover 26*b* are wired to the electric line wiring section 37 formed in the plug main body 31, and are also wired along left and right wiring paths C3. The left and right wiring paths C3 are set in a circumferential direction as centered around the central portion P2, which is set at a central portion of the electric line wiring section 37 in the width direction B.

The electric line 35 is wired at a central portion of the electric line wiring section 37 in a state of being more relaxed than the electric lines 34.

On the wiring paths C3, electric line holding sections 37*a*, 37*b* and 37*c* are located. The electric line holding sections 37*a*, 37*b* and 37*c* hold the electric lines 34 in a state of being deformed in the width direction B perpendicular to the wiring paths C3 to be U-shaped around the central portion P2, or correct the electric lines 34 into such a state. The electric line holding sections 37*a* are located at an equal distance from the central portion P2, namely, on the circumference of a circle centered around the central portion P2; the electric line holding sections 37*b* are located at an equal distance from the central portion P2, namely, on the circumference of a circle centered around the central portion P2; and the electric line holding sections 37*c* are located at an equal distance from the central portion P2, namely, on the circumference of a circle centered around the central portion P2.

The electric line holding sections 37*a* through 37*c* are arranged in the circumferential direction along the wiring paths C3, with such a gap that allows the electric lines 34 to be wired. Also, the electric line holding sections 37*a* through 37*c* are located in a hound's tooth check, such that the wiring paths C3 are alternate, more specifically, outer to the electric line holding sections 37*a* and 37*b* and inner to the electric line holding section 37*c*, with respect to the central portion P2.

The electric line holding sections 37*a* are each located outer to a phantom line extended in the longitudinal direction A from a tip-side outer circumferential portion of the outer cover 36*b* of the cord 36, and are each eccentric externally with respect to the wiring path C3. The electric line holding sections 37*b* and 37*c* are each located outer to the phantom line and are each eccentric internally with respect to the wiring path C3.

Between the electric line holding sections 37*b* and 37*c*, the terminals 32 connected to the electric lines 34 are located.

The electric lines 34 are wired to the electric line wiring section 37 of the plug main body 31 as follows. As shown in FIGS. 3A and 3B, the electric lines 34 exposed from the tip of the outer cover 36*b* of the cord 36 are wired in a symmetrical manner along the left and right wiring paths C3, which are set in the electric line wiring section 37 of the plug main body 31.

This will be described more specifically. The electric lines 34 are each deformed in the width direction B perpendicular to the wiring paths C3 to be U-shaped, and deformed portions 34*c*, 34*d* and 34*e* obtained in this manner are hooked along the electric line holding sections 37*a*, 37*b* and 37*c* located on the wiring paths C3, such that the deformed portions 34*c*, 34*d* and 34*e* are wound around the electric line holding sections 37*a*, 37*b* and 37*c*. Thus, the electric lines 34 are wired in an S-shaped winding state as shown in FIG. 3B.

This will be described in more detail. As in the above-described embodiments, the tensile load applied to the cord 36 of the plug 30 acts to extend straight the deformed portions 34*c* through 34*e* of the electric lines 34 hooked along the electric line holding sections 37*a* through 37*c* of the electric line wiring section 37.

However, the deformed portions 34*c* through 34*e* of the electric lines 34 are held in, or corrected into, a deformed state by the electric line holding sections 37*a* through 37*c*. Therefore, as the tensile load is applied more to the electric lines 34, the deformed portions 34*c* through 34*e* of the electric lines 34 are pressed more to the electric line holding sections 37*a* through 37*c* (see FIG. 3B).

Owing to this, the tensile load applied to the electric lines 34 can be received by the electric line holding sections 37*a* through 37*c* to which the deformed portions 34*c* through 34*e* of the electric lines 34 are pressed.

As a result, the tensile load is applied in a dispersed manner to the electric line holding sections 37*a* through 37*c* and also dispersed in the circumferential direction. Therefore, the tensile load received by each of the electric line holding sections 37*a* through 37*c* is made small. Thus, the structural strength and the durability against the tensile load are improved.

In addition, the tensile load is prevented from being directly applied to connection portions of the terminals 32 and the electric lines 34, and thus functions and effects equivalent to those of the above-described embodiments can be provided.

Moreover, an anti-drawing effect that the cord 36 is prevented from being drawn from the plug main body 31, and a breakage prevention effect that the cord 36 is prevented from being broken, are provided.

Now, an electric line wiring structure of a straight plug 40 according to still another example will be described.

Figure 4A:
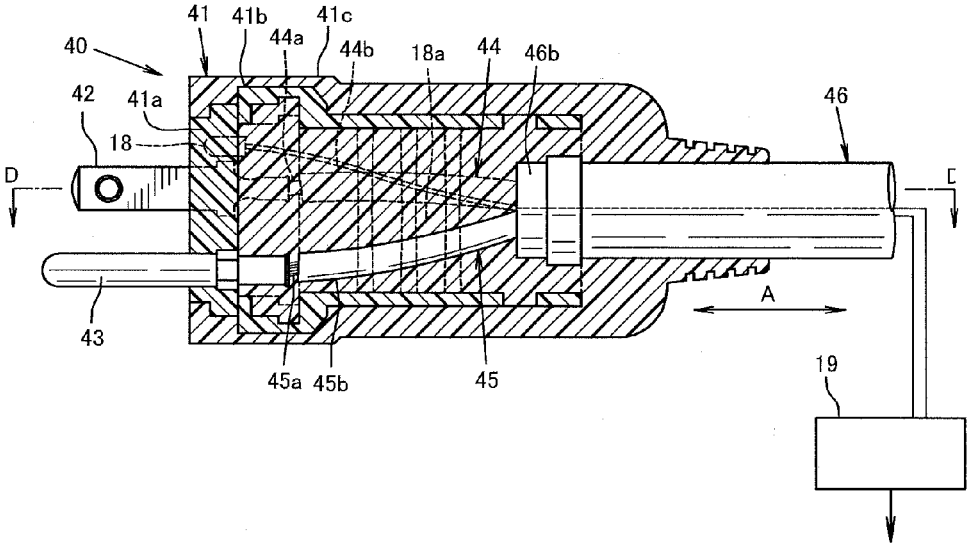
FIGS. 4A and 4B provide a vertical cross-sectional view showing an electric line wiring structure of a plug including a ground terminal, and a cross-sectional view taken along line D-D which shows a wiring state of electric lines.
Figure 4B:
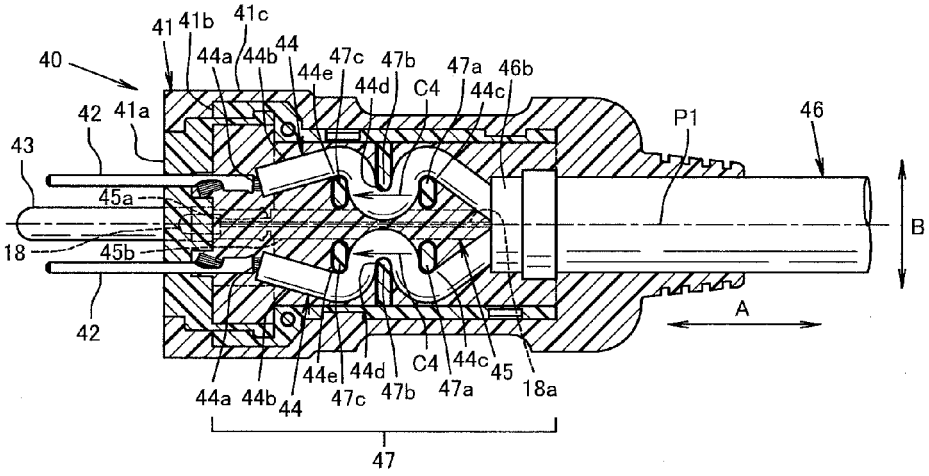

FIG. 4A is a vertical cross-sectional view showing an electric line wiring structure of the plug 40 including a ground terminal. FIG. 4B is a cross-sectional view taken along line D-D, which shows a wiring state of electric lines 44 and 45.

The plug 40 is a straight plug in which terminals 42 and 43 and the electric lines 44 and 45 are respectively connected to each other in a generally linear manner. The plug 40 includes a cylindrical plug main body 41 formed of an insulating plastic material by molding, two flat terminals 42 protruding at a front end of the plug main body 31, a pin-shaped ground terminal 43 protruding at the front end, and a cord 46 for binding together electric lines 44 connected to the terminals 42 and an electric line 45 connected to the terminal 43. The cord 46 is connected on a rear side of the plug main body 41.

The plug main body 41 is structured as follows. A base portion of each of the terminals 42 and a base portion of the terminal 43 are assembled to a core insert member 41*a* formed of a thermosetting plastic material. Then, semicircular arc-shaped insert members 41*b* formed of a thermosetting plastic material are fit to both of two sides of an outer circumferential surface of the insert member 41*a* so as to sandwich the insert member 41*a*.

Edges of the insert members 41*b* facing each other are engaged with each other to integrate the insert members 41*a* and 41*b* together. Then, the members 41*a* and 41*b* are covered with a cover-shaped plug body 41*c* formed of a thermoplastic material. Thus, these elements are integrated together to be straight as seen in a side view.

The plug body 41*c* is formed of the above-described thermoplastic material by an injection molding device (not shown) and covers an outer surface of the insert members 41*a* and 41*b* except for a front end surface of the insert member 41*a* and a tip-side outer circumferential surface of the cord 46.

The thermoplastic material fills the inside of the plug main body 41 at the time of injection molding. Therefore, the terminals 42 and 43 are fixed as protruding at the front end of the insert member 41*a*, and the electric lines 44 and 45 are fixed in a prescribed wiring state.

The terminals 42 protrude parallel to each other with such a gap that allows the terminals 42 to be inserted into insert openings of an electric outlet (not shown). The terminal 43 protrudes at such a position that allows the terminal 43 to be inserted into a ground opening of the electric outlet.

The electric lines 44 and 45 are respectively deprived of tips of insulating members 44*b* and 45*b* provided to cover outer circumferential surfaces of core wires 44*a* and 45*a*, so as to expose the core wires 44*a* and 45*a*. The core wires 44*a* and 45*a* exposed from the tips of the insulating members 44*b* and 45*b* are respectively pressure-connected to the base portions of the terminals 42 and 43.

The cord 46 binds together and covers the electric lines 44 and 45 with an insulating outer cover 46*b*. The cord 46 is deprived of a tip of the outer cover 46*b* so as to expose the electric lines 44 and 45 by prescribed lengths from the tip of the outer cover 46*b*. The tip of the outer cover 46*b* is connected to an electric line wiring section 47 (described later) on the rear side of the plug main body 41.

The electric lines 44 exposed from the tip of the outer cover 46*b* are wired to the electric line wiring section 47 formed in the plug main body 41, and are also wired along left and right wiring paths C4. The left and right wiring paths C4 are set on both of two sides of the center line P1, which is set at a position passing a central portion of the electric line wiring section 47 in a width direction B, and are parallel to the longitudinal direction A of the plug main body 41.

The electric line 45 is wired at a central portion of the electric line wiring section 47 in a state of being more relaxed than the electric lines 44.

On the wiring paths C4, electric line holding sections 47*a*, 47*b* and 47*c* are located. The electric line holding sections 47*a*, 47*b* and 47*c* hold the electric lines 44 in a state of being deformed in the width direction B perpendicular to the wiring paths C4 to be U-shaped, or correct the electric lines 44 into such a state.

The electric line holding sections 47*a*, 47*b* and 47*c* are arranged in the longitudinal direction A along the wiring paths C4, with such a gap that allows the electric lines 44 to be wired, and are positionally shifted in the width direction B so as to be located alternately with respect to the wiring paths C4, more specifically, in a hound's tooth check.

The electric line holding sections 47*a* and 47*c* are each located outer to a tip-side central portion of the outer case 46*b* of the cord 46 and inner to a phantom line extended in the longitudinal direction A from a tip-side outer circumferential portion of the outer cover 46*b*. The electric line holding sections 47*b* are each located on the phantom line, and extend perpendicularly to the wiring path C4 and protrude toward an inside wall of the electric line wiring section 47.

The electric lines 44 are wired to the electric line wiring section 47 of the plug main body 41 as follows. As shown in FIGS. 4A and 4B, the electric lines 44 exposed from the tip of the outer cover 46*b* of the cord 46 are wired in a bilaterally symmetrical manner along the wiring paths C4, which are set in the electric line wiring section 47 of the plug main body 41.

This will be described more specifically. The electric lines 44 are each deformed in the width direction B perpendicular to the wiring paths C4 to be U-shaped, and deformed portions 44*c*, 44*d* and 44*e* obtained in this manner are hooked along the electric line holding sections 47*a*, 47*b* and 47*c* located on the wiring paths C4. Thus, the electric lines 44 are wired in an S-shaped winding state as shown in FIG. 4B.

This will be described in more detail. As in the above-described embodiments, the tensile load applied to the cord 46 of the plug 40 acts to extend straight the deformed portions 44*c* through 44*e* of the electric lines 44 hooked along the electric line holding sections 47*a* through 47*c* of the electric line wiring section 47.

However, the deformed portions 44*c* through 44*e* of the electric lines 44 are held in, or corrected into, a deformed state by the electric line holding sections 47*a* through 47*c*. Therefore, as the tensile load is applied more to the electric lines 44, the deformed portions 44*c* through 44*e* of the electric lines 44 are pressed more to the electric line holding sections 47*a* through 47*c* (see FIG. 4B).

Owing to this, the tensile load applied to the electric lines 44 can be received by the electric line holding sections 47*a* through 47*c* to which the deformed portions 44*c* through 44*e* of the electric lines 44 are pressed, and also the tensile load can be dispersed in the width direction B.

As a result, the tensile load applied to the electric lines 44 is applied in a dispersed manner to the electric line holding sections 47*a* and 47*c* located at inner positions and the electric line holding sections 47*b* located at outer positions, and is also dispersed in the width direction B. Therefore, the tensile load received by each of the electric line holding sections 47*a* through 47*c* is made small. Thus, a structural strength which can withstand even a large tensile load is guaranteed, and the durability is improved.

In addition, the tensile load applied to the electric lines 44 is prevented from being directly applied to connection portions of the terminals 42 and the electric lines 44, and thus functions and effects equivalent to those of the above-described embodiments can be provided.

Moreover, an anti-drawing effect that the cord 46 is prevented from being drawn from the plug main body 41, and a breakage prevention effect that the cord 46 is prevented from being broken, are provided.

Figure 5A:
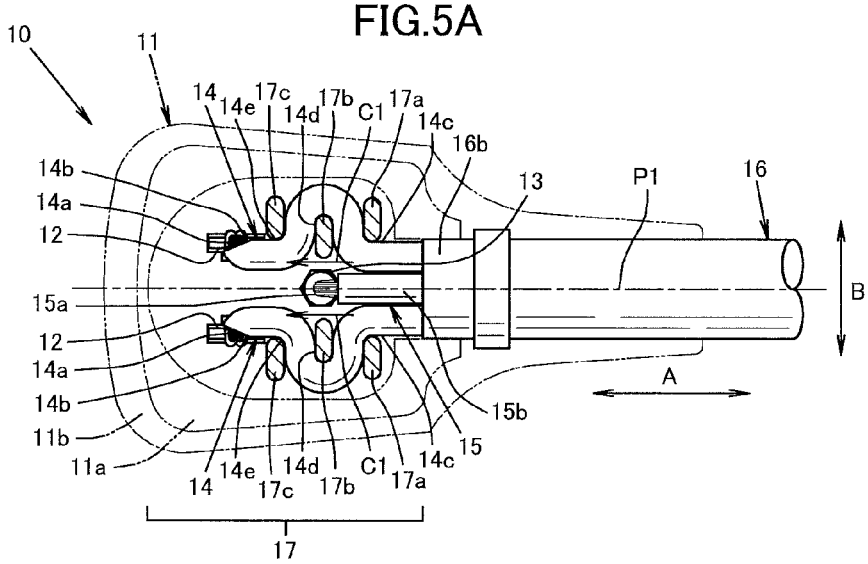
FIGS. 5A and 5B provide other examples of wiring of electric lines.
Figure 5B:
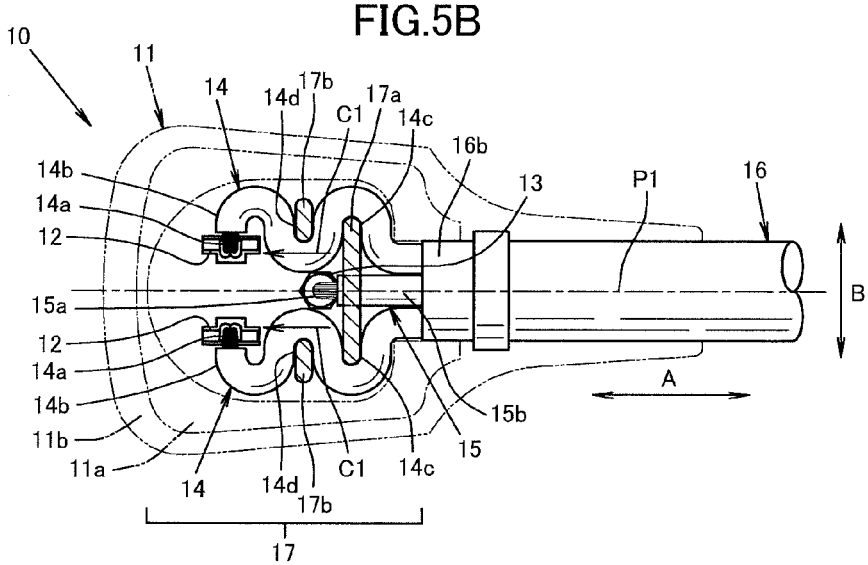

Now, other examples of wiring of the electric lines will be described with reference to FIGS. 5A and 5B. FIGS. 5A and 5B each show another example of wiring of the electric lines 14 in the plug 10.

The electric lines 14 are wired as follows. The deformed portions 14*d*, each obtained as a result of deforming the electric line 14 of the cord 16 to be U-shaped, are hooked along the electric line holding sections 17*b* located inner to the electric lines 14 and closer to the center line P1. The deformed portions 14*c* and 14*e* formed forward and rearward to the deformed portions 14*b* are respectively hooked along the electric line holding sections 17*a* and 17*c* located outer to the electric line holding sections 17*b* (see FIG. 5A).

Alternatively, the deformed portions 14*c*, each obtained as a result of deforming the electric line 14 of the cord 16 to be U-shaped, are hooked along side edges of the electric line holding section 17*a*. The electric line holding section 17*a* is formed to have a width larger than an outer diameter of the cord 16 and is located on the center line P1 at the central portion of the electric line wiring section 17. The deformed portions 14*d* of the electric lines 14 are hooked along the electric line holding sections 17*b* (see FIG. 5B).

The tensile load applied to the cord 16 of the plug 10 acts to press the deformed portions 14*c* through 14*e* (or 14*c* and 14*d*) of the electric lines 14 to the electric line holding sections 17*a* through 17*c* (or 17*a* and 17*b*).

Owing to this, the tensile load applied to the electric lines 14 can be received by the electric line holding sections 17*a* through 17*c* (or 17*a* and 17*b*) to which the deformed portions 14*c* through 14*e* (or 14*c* and 14*d*) of the electric lines 14 are pressed.

By wiring the electric lines 14 as described above, the tensile load is prevented from being directly applied to connection portions of the terminals 12 and the electric lines 14, and thus functions and effects equivalent to those of the above-described embodiments can be provided.

The electric line 15 is wired to a central portion. In the example shown in FIG. 5B, the electric line 15 is inserted into a hole (not shown) formed in the electric line holding section 17*a*.

Figure 6A:
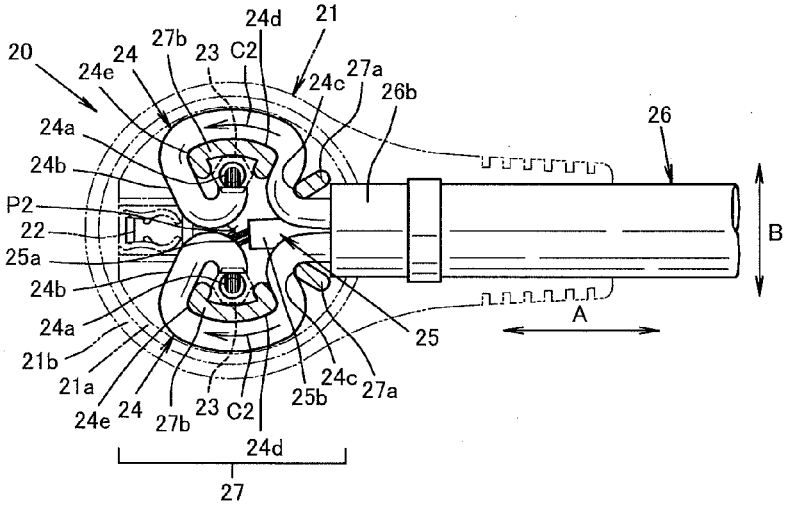
FIGS. 6A and 6B provide other examples of wiring of electric lines.
Figure 6B:
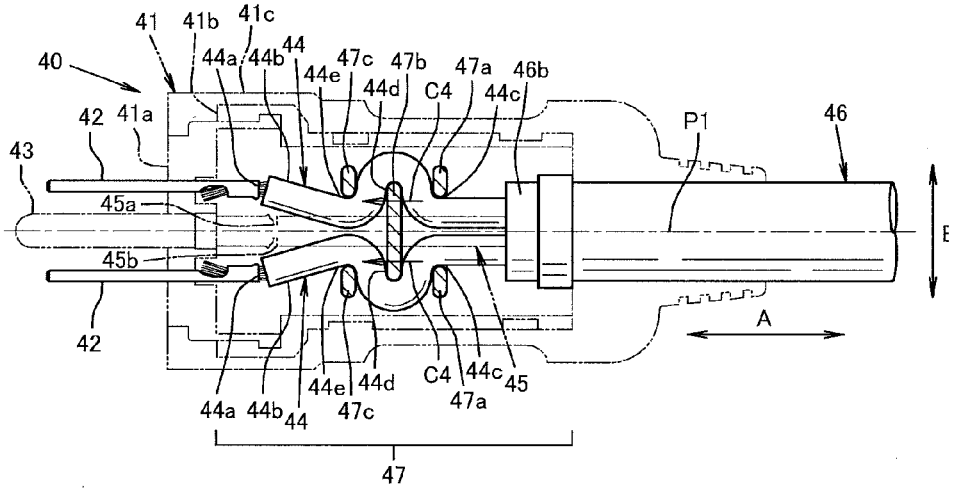

Now, other examples of wiring of the electric lines 24 and 44 will be described with reference to FIGS. 6A and 6B. FIG. 6A shows another example of wiring of the electric lines 24 in the plug 20, and FIG. 6B shows another example of wiring of the electric lines 44 in the plug 40.

The electric lines 24 are wired as follows. The deformed portions 24*d* and 24*e*, each obtained as a result of deforming the electric line 24 of the cord 26 to be U-shaped, are hooked along front and rear edges of the electric line holding sections 27*b*, such that the deformed portions 24*d* and 24*e* are wound around the electric line holding sections 27*b*. The electric line holding sections 27*b* are formed to be arc-shaped as seen in a plan view and have a large radius of curvature. The deformed portions 24*c* of the electric lines 24 are hooked along the electric line wiring sections 27*a* (see FIG. 6A).

The tensile load applied to the cord 26 of the plug 20 acts to press the deformed portions 24*c* through 24*e* of the electric lines 24 to the electric line holding sections 27*a* and 27*b*.

Owing to this, the tensile load applied to the electric lines 24 can be received by the electric line holding sections 27*a* and 27*b* to which the deformed portions 24*c* through 24*e* of the electric lines 24 are pressed. In addition, since the radius of curvature of the electric line holding sections 27*b* is large, the stress applied to the electric lines 24 can be alleviated, and thus the electric lines 24 can be prevented from being broken.

The electric lines 44 are wired as follows. The deformed portions 44*d*, each obtained as a result of deforming the electric line 44 of the cord 46 to be U-shaped, are hooked along side edges of the electric line holding section 47*b*. The electric line holding section 47*b* is formed to have a width approximately equal to, or larger than, an outer diameter of the cord 46. The deformed portions 44*c* and 44*e* formed forward and rearward to the deformed portions 44*d* are respectively hooked along the electric line holding sections 47*a* and 47*c* located forward and rearward to the electric line holding section 47*b* (see FIG. 6B).

The tensile load applied to the cord 46 of the plug 40 acts to press the deformed portions 44*c* through 44*e* of the electric lines 44 to the electric line holding sections 47*a* through 47*c*.

Owing to this, the tensile load applied to the electric lines 44 can be received by the electric line holding sections 47*a* through 47*c* to which the deformed portions 44*c* through 44*e* of the electric lines 44 are pressed.

By wiring the electric lines 24 and 44 as described above, the tensile load is prevented from being directly applied to connection portions of the terminals 22 and the electric lines 24 and connection portions of the terminals 42 and the electric lines 44, and thus functions and effects equivalent to those of the above-described embodiments can be provided.

The electric line 45 is inserted into a hole (not shown) formed in the electric line holding section 47*b* and is wired to a central portion.

Figure 7:
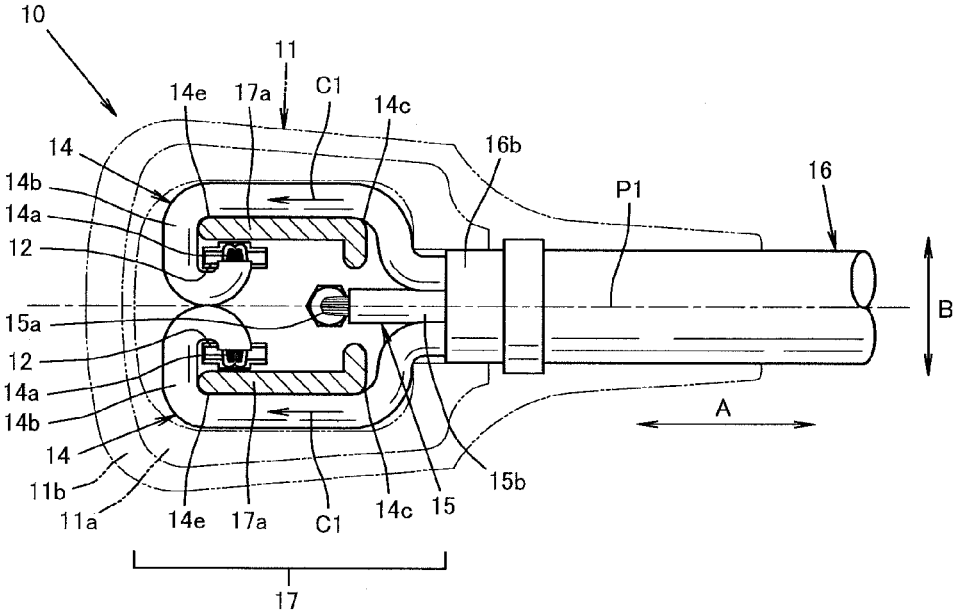
FIG. 7 shows another example of wiring of electric lines.

Now, another example of wiring of the electric lines 14 will be described with reference to FIG. 7. FIG. 7 shows another example of wiring of the electric lines 14 in the plug 10.

The electric lines 14 are wired as follows. The deformed portions 14*c* and 14*e*, each obtained as a result of deforming the electric line 14 of the cord 16 to be U-shaped, are hooked along front and rear edges of electric line holding sections 17*a*, such that the deformed portions 14*c* and 14*e* are wound around the electric line holding sections 17*a*. The electric line holding sections 17*a* are formed to be parallel to the longitudinal direction A of the plug main body 11 and have a cross-section which is longer in the longitudinal direction. As shown in FIG. 7, the deformed portions 14*c* and 14*e* are wired along the inside walls of the electric line wiring section 17.

The tensile load applied to the cord 16 of the plug 10 acts to press the deformed portions 14*c* and 14*e* of the electric lines 14 to the electric line holding sections 17*a*. A circumferential surface of each electric line 14 corresponding to the deformed portions 14*c* and 14*e* is pressed to an inside wall of the electric line wiring section 17 and is held in a U-shape-deformed state or corrected into such a state.

Owing to this, the tensile load applied to the electric lines 14 can be received by the front and rear edges of the electric line holding sections 17*a* to which the deformed portions 14*c* and 14*e* are pressed and the inside walls of the electric line wiring section 17.

By wiring the electric lines 14 as described above, the tensile load is prevented from being directly applied to connection portions of the terminals 12 and the electric lines 14, and thus functions and effects equivalent to those of the above-described embodiments can be provided.

In the above-described examples of wiring, identical elements bear identical reference signs, and detailed descriptions thereof are omitted.

The electric line wiring section according to the present invention corresponds to the electric line wiring sections 17, 27, 37, and 47 in the embodiments; and similarly, the electric line holding section corresponds to the electric line holding sections 17*a* through 17*c*, 27*a* through 27*c*, 37*a* through 37*c*, and 47*a* through 47*c*.

However, the present invention is not limited to the above-described embodiments, and can be applied based on technological idea recited in the claims and can be carried out in many other embodiments.

The electric line wiring structure of the plug according to the present invention is not limited to being used for a plug described in the embodiments which has a ground terminal protruding therefrom, and is applicable to, for example, a general plug having two terminals protruding therefrom.

In the above embodiments, the electric lines 14, 24, 34 and 44 are deformed in the width direction B to be wired in an S-shaped winding state. Alternatively, for example, the electric lines 14, 24, 34 and 44 may be deformed in the longitudinal direction to be wired in an S-shaped winding state.

The electric line wiring structures of the plugs 10, 20, 30 and 40 are not limited to being used as the structures of the plugs 10 through 40, and may be applicable as electric line wiring structures of other plugs.

REFERENCE SIGNS LIST

A . . . Longitudinal direction
B . . . Width direction
P1 Center line
P2 . . . Central portion
C1-C4 . . . Wiring path
10, 20, 30, 40 . . . Plug
11, 21, 31, 41 . . . Plug main body
12, 13, 22, 23, 32, 33, 42, 43 . . . Terminal
14, 15, 24, 25, 34, 35, 44, 45 . . . Electric line
14*c*-14*e*, 24*c*-24*e*, 34*c*-34*e*, 44*c*-44*e* . . . Deformed portion
16, 26, 36, 46 . . . Cord
17, 27, 37, 47 . . . Electric line wiring section
17*a*-17*c*, 27*a*-27*c*, 37*a*-37*c*, 47*a*-47*c* . . . Electric line holding section
18 . . . Thermistor
18*a* . . . Signal line
19 . . . Electric current block device

The invention claimed is:

1. An electric line wiring structure of a plug, the plug comprising a plurality of terminals to be inserted into a power supply, the plurality of terminals protruding on a front side of a plug main body; and two electric lines connected to the terminals, the electric lines being connected on a rear side of the plug main body, the electric line wiring structure comprising:

an electric line wiring section that wires the two electric lines connected to the terminals provided in the plug main body; and a plurality of electric line holding sections that hold each of the two electric lines in a deformed state, which are provided on a wiring path for wiring the electric lines, and which are set in the electric line wiring section, wherein the electric lines are deformed in a direction perpendicular to the wiring path;

wherein the wiring path is set in a circumferential direction as centered around a central portion located between the two electronic lines in the electric line wiring section; and wherein the plurality of the electric line holding sections are located along the wiring path set in the circumferential direction, spaced apart by a gap which allows the electric lines to be wired.

2. An electric line wiring structure of a plug according to claim 1, wherein a plurality of the electric line holding sections are located along the wiring path, spaced apart by a gap which allows the electric lines to be wired.

* * * * *